United States Patent [19]

Picard

[11] 4,192,535

[45] Mar. 11, 1980

[54] LOCKING MECHANISM

[76] Inventor: Jacques Picard, 15 Boulevard Flandrin, 75116 Paris, France

[21] Appl. No.: 927,295

[22] Filed: Jul. 24, 1978

[30] Foreign Application Priority Data

Jul. 26, 1977 [FR] France ..... 77 22975

[51] Int. Cl.[2] ..... E05C 1/06

[52] U.S. Cl. ..... 292/37; 292/159; 292/DIG. 18

[58] Field of Search ..... 292/157, 159, 162, 160, 292/161, 158, 140, 187, 136, 42, 33, DIG. 18, DIG. 68, 37

[56] References Cited

U.S. PATENT DOCUMENTS

| | | | |
|---|---|---|---|
| 1,212,993 | 1/1917 | O'Connor | 292/DIG. 18 |
| 1,775,092 | 9/1930 | French | 292/162 |
| 2,126,995 | 8/1938 | Kingdon | 292/36 UX |
| 2,241,577 | 5/1941 | Beals | 292/36 UX |
| 3,160,431 | 12/1964 | Anderson et al. | 292/42 |
| 3,175,873 | 3/1965 | Blomquist et al. | 292/159 X |

FOREIGN PATENT DOCUMENTS

| | | | |
|---|---|---|---|
| 1903179 | 8/1970 | Fed. Rep. of Germany | 292/DIG. 18 |
| 2404575 | 1/1974 | Fed. Rep. of Germany | 292/33 |
| 16849 | of 1911 | United Kingdom | 292/37 |
| 150064 | 8/1920 | United Kingdom | 292/37 |
| 228621 | 2/1925 | United Kingdom | 292/37 |

*Primary Examiner*—J. Franklin Foss
*Attorney, Agent, or Firm*—J. Harold Nissen

[57] ABSTRACT

A locking mechanism for locking a movable member to a stationary member such as a movable door to a stationary door frame which comprises a member fixed to the door frame and having a projecting rim which cooperates with a U-shaped longitudinal section having a portion for connection to the movable door. The U-shaped longitudinal section receives the projecting rim. The U-shaped longitudinal section is adapted to receive one or more bolts which pass through the walls of the longitudinal section and are adapted to engage within slots or recesses in the projecting rim. At least one slidingly mounted rod is provided to carry the bolts which pass through the slots or recesses in the walls of the U-shaped section and engage the tongue shaped notches for locking the projecting rim with the U-shaped section. Additionally, two vertically adjustable bolts are connected with the sliding rod and these are adapted to engage the threshold and lintel of the door frame.

12 Claims, 6 Drawing Figures

LOCKING MECHANISM

BACKGROUND OF THE INVENTION

This invention is concerned with a locking mechanism for locking a stationary member and a movable member to each other. More particularly, the invention is concerned with a multiple bolt lock for locking a door to a door frame or a window to a window frame.

In order to prevent house-breaking and for safety reasons, there's an increasing tendancy to provide multipoint closure locks. These multipoint closure locks generally comprise a plurality of catches which cooperate with a plurality of corresponding bolts and which can be actuated with one and the same mechanism, such as a key, a knob, or a handle.

The installation of such locks, and in particular their adaptation to door-frames or window frames requires relatively delicate and lengthy carpentry, and in many instances detailed locksmithing work. This considerably raises the cost of the lock installed.

In other situations, it is oftentimes necessary to undercut the frame and/or the door which can mar the outer surface portion as well as require expensive reconstruction.

It is therefore an object of the invention to provide a locking device which can be easily and simply installed on existing door frames.

A further object of the invention is to provide a locking device which can be installed onto an existing door frame by means of and with the use of a minimal of carpentry and locksmithing work.

Another object of the invention is to provide a lock which would make it possible to obtain a perfect closure, and not have the operation of the lock disturbed in case of deformation due to warping of the door frame.

SUMMARY OF THE INVENTION

In order to accomplish the aforesaid objects, the invention proposes the provision of a multiple catch lock which generally comprises a vertical section or chamber designed to cover the flaps of the door frame and having a generally S-shaped section. The vertical section or chamber includes a generally U-shaped longitudinal section which is adapted to receive a projecting rim so as to lock the U-shaped section to the projecting rim. More specifically, the U-shaped section includes a member connected to one leg or arm thereof for connection to the door frame.

In one specific preferred embodiment, the S-shaped member includes a first relatively wide U-shaped form having a core bar or base which is designed to be applied onto the flap or face of the door, and a second relatively narrow U-shaped form which is inverted or reversed with respect to the first U-shaped form, with both U-shaped forms having a common leg or arm of the U. At least one rod and preferably two rods being slidably mounted within the larger U-shaped form; preferably, when two slidingly mounted rods are provided, they are movable towards each other for opening of the locking mechanism and movable away from each other for the closing and locking of the locking mechanism. A conventional locking mechanism or a lock per se is provided which is operable by means of a key, knob or actuating handle, and this locking mechanism is connected with the rods for movement thereof in an axial direction. One of the U-shaped sections is provided with one or more elongated recesses in each arm or leg of the U-shaped section, which elongated recesses are aligned with each other, and a bolt which extends through the elongated recesses is fixed to the slidable rod for movement in the elongated recesses in response to the sliding movement of the rod caused by the movement of the locking mechanism.

Attached to the casing is a fixed member having the projecting rim which fits between the legs of the smaller U-shaped section. The projecting rim is provided with an elongated tongue-shaped notch or recess for each of the bolts. The elongated tongue is open at the edge of the projecting rim and in the unlocking condition of the locking mechanism, with the door closed is adapted to receive the bolts, and the sliding movement imparted to the sliding rod moves the bolts into the tongue-shaped notches for locking engagement with the projecting rim and, therefore, the door frame. The tongue-shaped notch performs the function of a catch and the member which was connected to the door frame should include at least one inclined plane such as a flat bar or latch set on the casing of the door frame. This bar must include the projecting rim and be designed to be housed in the second U-shaped form in the closed position of the door and door frame. This catch consists of the tongue-shaped notch which opens onto the external vertical rim of the inclined plane, at the level of the bolt when the latter is in an open position.

At least one bolt is mounted on the end part of the rod and co-operates with a catch provided on the threshold and/or on the lintel of the door-frame.

According to another characteristic of the invention, the lock comprises two substantially coaxial rods located on either side of the lock mechanism, and two bolts at their respective opposite ends of the two bolts, the height of which is adjustable. These two bolts also cooperate respectively with two catches respectively mounted within the threshold and the lintel of the door frame. The lock mechanism is provided so as to cause the two rods upon actuation thereof to slide in opposite directions.

According to another preferred embodiment of the invention, the two rods at their adjacent end parts are connected to two connecting parts. These two parts respectively comprise two pins engaged in two spiral grooves which are respectively provided on a pivotally mounted driving disc and which can be driven or set into rotation by means of a key, a knob or an actuating handle.

Thus, in order to decrease the effort required to open or close the lock, the spiral grooves can extend arcuately around the driving disc over a curve more than 360°.

Other objects, advantages and the nature of the invention will become readily apparent from the detailed description of the invention described in connection with the accompanying drawings.

DESCRIPTION OF THE PREFERRED EMBODIMENTS

Figure 1:
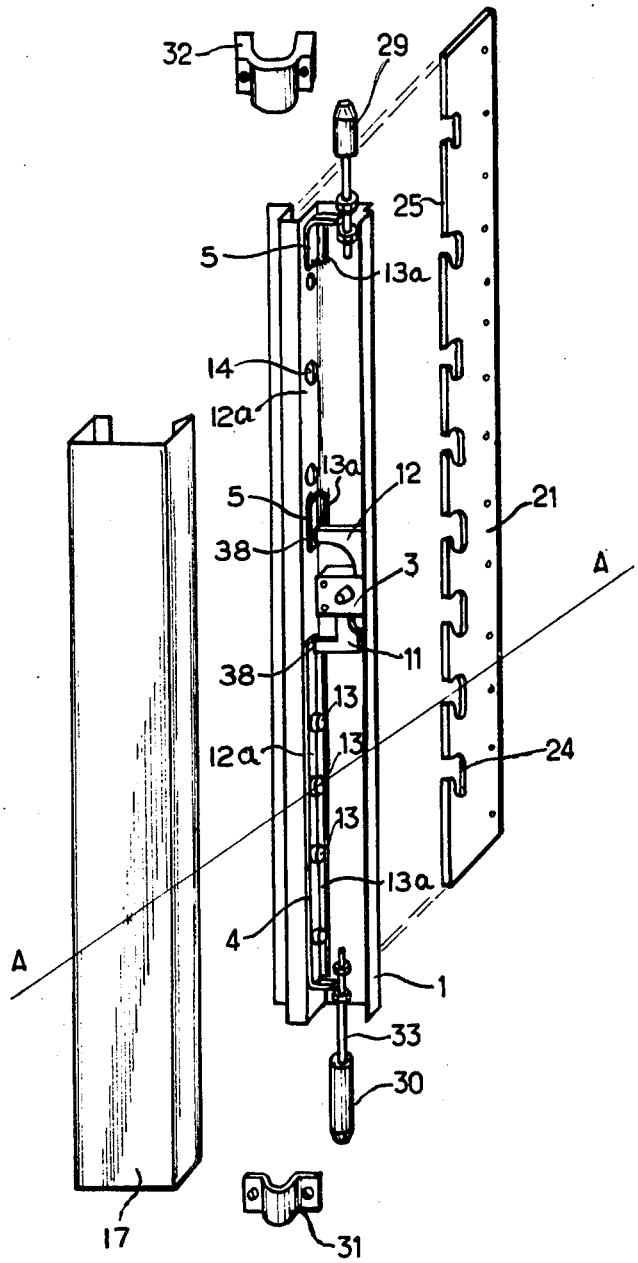
FIG. 1 is an exploded diagrammatic perspective view of the lock assembly.
Figure 2:
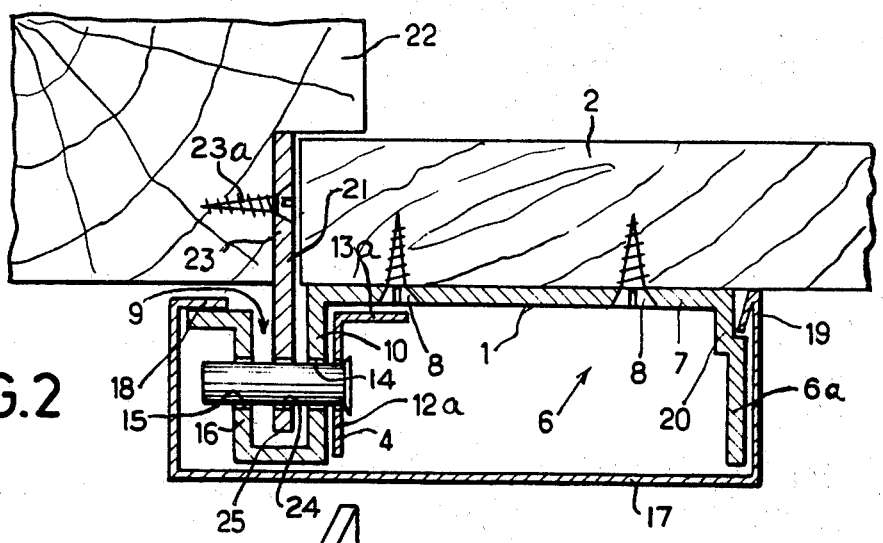
FIG. 2 is an enlarged cross-sectional view of the lock assembly taken along line A—A of FIG. 1 showing the lock assembly connected with a door and a door frame.
Figure 3:
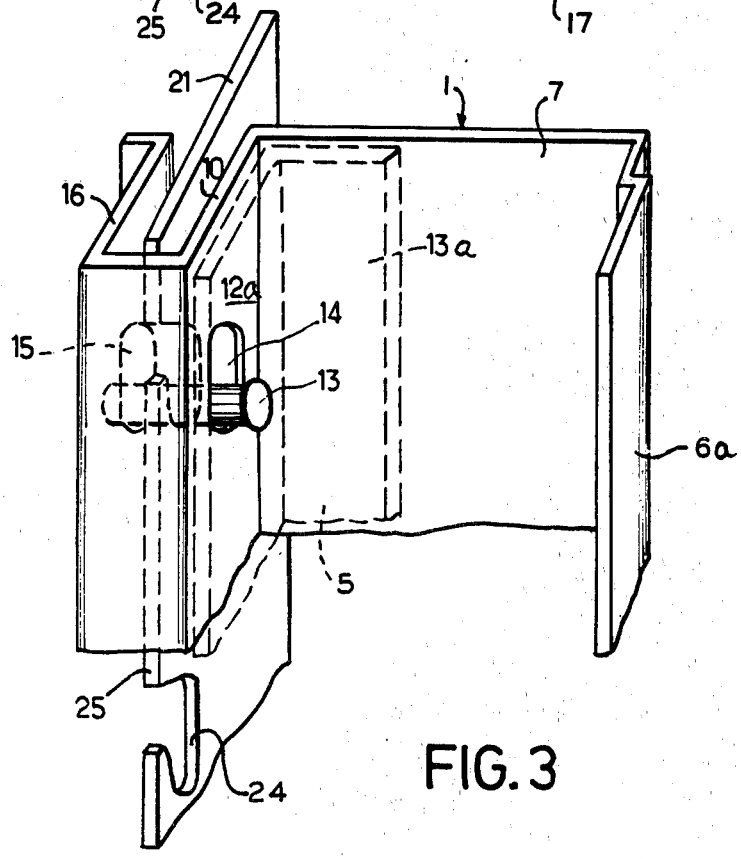
FIG. 3 is a partial perspective view of the lock shown in section in FIG. 2 with the door and door frame omitted.

Referring now to the drawings which illustrate the presently preferred mode of practising the invention, and in particular to FIGS. 1 to 3, the multiple bolt lock comprises a chambered device which is shown as a vertical chamber device 1, adapted to be fastened to the flap or face of a door 2. Vertical chamber device 1 includes first and second U-shaped sections or forms 6 and 9, respectively having a common arm or leg 10. Specifically, the first U-shaped section 6 comprises a base or core bar 7 and a pair of arms or legs 10 and 6*a*. The second U-shaped section also includes a pair of arms or legs 10 and 16, with arm 10 being common to the first and second U-shaped sections. As best seen in FIG. 1, a locking mechanism 3 is located in the first U-shaped section 6 in a median portion thereof. Connected with locking mechanism 3 are a pair of rods 4 and 5, positioned within the first U-shaped section and movable longitudially of the aforesaid U-shaped sections in a direction opposite to each other. Slidingly mounted rods 4 and 5 are connected to opposite sides of locking mechanism 3 by means of connecting parts 11 and 12, respectively so that rotation of the locking mechanism will move connecting parts 11 and 12 in a longitudinal direction opposite to each other and therefore the rods 4 and 5 in a direction opposite to each other. Of course, rotation or movement of the lock in the opposite direction will cause connecting parts 11 and 12 to be moved towards each other and therefore rods 4 and 5 will move longitudinally towards each other.

As shown more particularly in FIGS. 2 and 3, the vertical chamber 1 is provided with a section which is generally S-shaped. More specifically, this chamber has the relatively wide U-shaped form 6 with the core-bar 7 fastened to the flap of door 2 by means of screws 8, and the narrower U-shaped form 9, which is inverted with respect to the U-shaped form 6 whereby they have the common arm 10. Lock mechanism 3, connecting parts 11, 12, and rods 4 and 5, are provided within U-shaped form 9. Each of the connecting rods 4 and 5 comprise an angle bar having a pair of legs 12*a* and 13*a*. The angle bar forming rod 4 is shown in section in FIG. 2 and the angle bar forming rod 5 is shown in phantom in FIG. 3.

Arm 12*a* of each of the angle bars rides on and is in contact with common arm 10 which is common to both U-shaped forms 6 and 9, and the other angle arm or leg 13*a* rests on the core-bar or base 7 of U-shaped form 6.

Each of the arms 12*a* of the angle bars carries a series of deadlocks 13, and these extend perpendicularly to the arms 12*a*. Five of the deadlocks 13 are shown on each of the arms 12*a*.

Legs 10 and 16 of the smaller U-shaped form 9 are provided with at least one pair of elongated recesses 14 and 15 respectively, which are aligned with each other and are adapted to receive the deadlocks 13. More specifically, a pair of elongated recesses 14 and 15 are provided for each of the deadlocks 13. Because of the elongated recesses 14 and 15, deadlocks 13 can be displaced vertically or longitudinally of arms 10 and 16.

Chamber device 1 can be closed by means of a plug terminal 17 which is substantially rectangularly shaped with one side open. More specifically, plug terminal 17 includes a longitudinal rim 18 which extends over a projecting lip or edge forming an extention of the outer edge of arm 16. The other side of plug terminal 17 includes a gripper 19 which cooperates with a longitudinal uncoupling lever 20 provided on the external face of arm 6*a* of U-shaped form 9.

Door frame 22 is provided with a groove 23 to receive a locking catch member 21. Groover 23 is sufficiently undercut so that the width of member 21 does not prevent the door from closing. Locking catch member 21 is provided with a catch for each of the deadlocks 13. For this purpose, locking member 21 is provided with a free rim 25 or projecting rim which extends into the space 9 between the arms 16 and 10 of the second or smaller U-shaped member, and includes a tongue-shaped notch 24 in alignment with each of the pair of recesses 14 and 14 so as to receive the deadlock 13 and lock the door to the door frame.

As best seen in FIG. 2, the locking catch member 21 consists of a metallic flat bar having a width greater than the groove 23 on which it is fastened by means of screw 23*a*.

The catches consist of the tongue-shaped notches 24 provided in that part of the locking catch member 21 projecting from casing 22 and open on the free or projecting rim 25 of locking catch member 21, at the level of the respective bolts 13 when the latter are in the open position.

Figure 4:
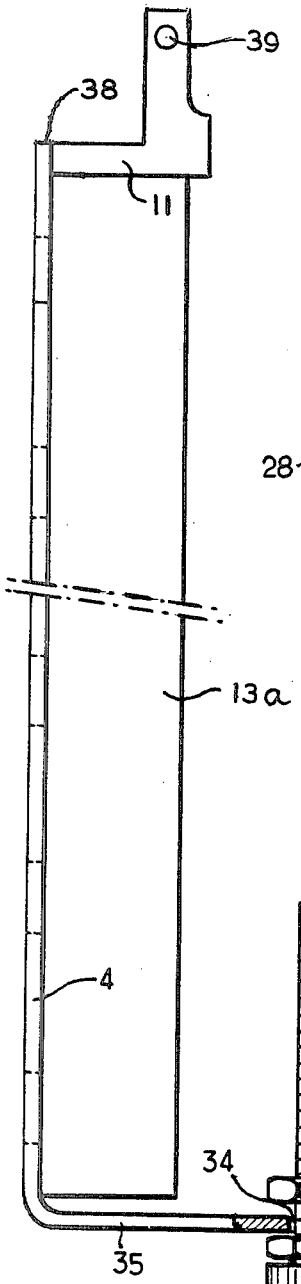
FIG. 4 shows a top view of a driving disc.
Figure 4:
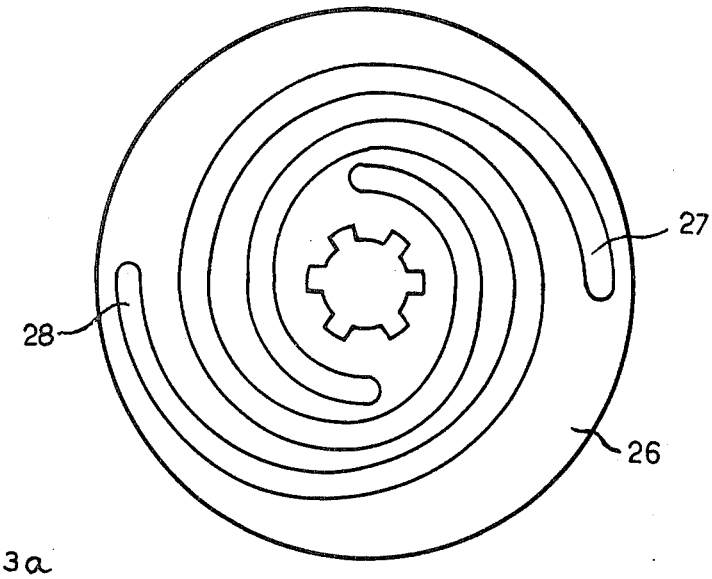
Figure 5:
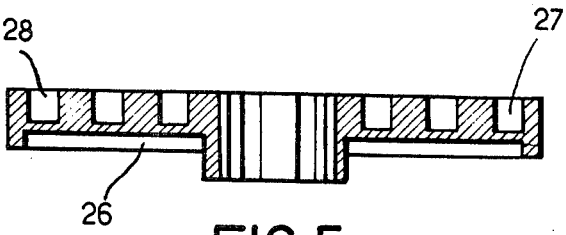
FIG. 5 is transverse axial section of the driving disc shown in FIG. 4.

Referring to FIGS. 4 and 5, the lock mechanism comprises a driving disc 26 rotatably mounted within the axis of the lock barrel of the locking mechanism and can be driven either by means of a key, a knob or an actuating handle.

This disc 26 comprises spiral grooves 27, 28 passing around its own central axis at an angle or for an arcuate portion greater than 360°.

Each of the connecting parts 11 and 12 is provided with a pin, 39 (FIG. 6) which is adapted to ride within and engage grooves 27 and 28 so that by turning the actuating disc 26, the rotary motion of the disc 26 is changed to translation motion for the connecting parts 11 and 12 which in turn cause the longitudal movement of rods 4 and 5 away from each other and towards each other.

In this respect it should be noted that, as a result of the number of bolts 13, it is necessary to exert a substantial force in order to operate this lock. It is for this reason that grooves 27, 28 were made to extend around the axis of disc 26 for more than one turn or over an arcuate path greater than 360° so as to actuate the bolts by one-half of a rotation without continuing the operation of the deadlocks after a complete rotation of 360°. Such an arrangement which makes it impossible to tamper with the lock since the lock cannot return backwards if the key is not actuated, makes it possible, in addition, to avoid the use of a groove.

Figure 6:
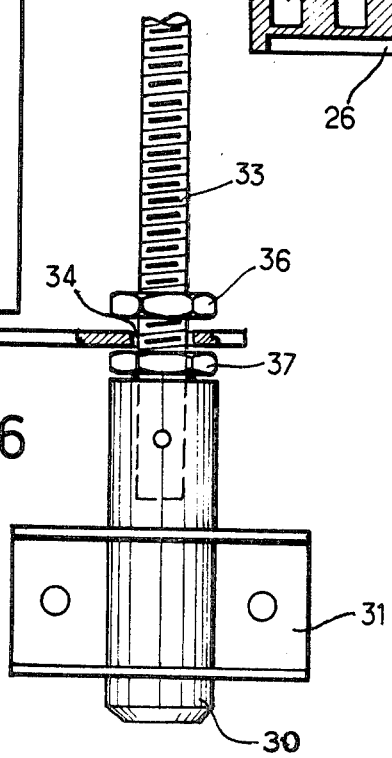
FIG. 6 shows the locking bolt at the end part of the rod with the mounting system, and held by its cooperating catch, and means to adjust the height of the bolt relative to the rod.

Referring to FIGS. 1 and 6, the lock or lock mechanism additionally comprises two plug bolts 29, 30. One bolt 29 cooperating with a catch 31 mounted on the threshold of the door frame and the other bolt 30 cooperating with a catch 32 mounted on its lintel.

The bolts 29 and 30 are mounted on the respective end parts of rods 4 and 5 by means of a height adjustment system.

Referring to FIG. 6, bolts 29 and 30 are fastened to the end part of a threaded rod 33 which passes through a boring 34 provided on a return or projecting leg of an L portion 35 set on the end part of rods 4 and 5. The adjustment and fastening into position of the bolt 29 or 30 is obtained by means of two nuts 36 and 37 respectively positioned on opposite sides of a boring 34 in return 35. Thus this arrangement makes it possible to set the lock in accordance with the dimensions of the door. This adjustment takes into consideration variations from conventional dimensions.

It will be noted that pin 39 is carried by connecting part 11 which is attached at the end 38 of connecting rod 4 which is in the form of the angle bar.

It should also be noted that in the above described lock, all displacements are reversible. Therefore, the lock can be installed on the right or on the left merely by changing the direction of movement of the barrel of the lock mechanism.

While there has been shown what is considered to be the preferred embodiments of the invention, it will be obvious that various changes and modifications may be made therein without departing from the scope of the invention.

I claim:

1. In a lock mechanism for locking a movable member to a stationary member, such as a movable door to a stationary door frame, comprising:

a vertical chamber device connected with said movable door and including at least one U-shaped longitudinal section, said U-shaped section having a base and a pair of longitudinally extending legs having a chamber therebetween;

at least one rod mounted for sliding movement in said chamber longitudinally of said legs;

a locking mechanism associated with said rod and including means to displace said rod longitudinally of said legs;

at least one bolt integrally connected with said rod extending cross-wise within said U-shaped longitudinal section; each leg of said U-shaped section having at least one longitudinally elongated recess forming at least one pair of recesses, said at least one pair of recesses being aligned cross-wise of said U-shaped section, said at least one bolt extending through said aligned recesses and having freedom of movement longitudinally within said longitudinally elongated recesses;

A member fastened to said stationary door frame and including a projecting rim projecting beyond said frame and receivable within said chamber in said U-shaped section, said projecting rim having at least one tongue-shaped notch opening at the portion thereof receivable within said U-shaped section and an inclined portion, said at least one notch being aligned with said at least one bolt and being at the level thereof when said rod positions said at least one bolt in an open condition of the lock mechanism;

a plug terminal consisting of a rectangular section, open on one side, closing said vertical chamber device; and, means fastening said plug terminal to said vertical chamber device comprising a longitudinal rim on one side cooperating with a rim set on one of the external legs of said chamber and by means of a gripper on the other side, a longitudinal uncoupling lever cooperating with said gripper, said uncoupling lever being provided on the external face of the other external leg of the chamber.

2. In a lock mechanism for locking a movable member to a stationary member, such as a movable door to a stationary door frame, comprising:

a vertical chamber device connected with said movable door and including a U-shaped longitudinal section having a chamber overlying said door frame when the door is closed;

at least one member fastened to said stationary door frame and including a projecting rim projecting beyond said frame into said chamber when the door is closed, said projecting rim having at least one notch opening at the portion thereof receivable within said U-shaped section; and, at least one rod mounted for movement in said chamber longitudinally of said U-shaped section, said rod including at least one bolt connected with said rod extending cross-wise within said U-shaped section cooperating with said at least one notch when the door is closed.

3. The lock mechanism as claimed in claim 2, wherein said vertical chamber device includes a second U-shaped section having a base in the form of a core bar and a pair of arms connected with said core bar, said first and said second U-shaped sections together forming an S-shaped section with one of the legs of said first U-shaped section forming a common wall with one of the arms of said second U-shaped section, said core bar being connected with said door.

4. The lock mechanism as claimed in claim 2 or 3 including:

at least one plug bolt, said rod having an end part, and said bolt being mounted on said end part; and, a catch mounted on said door frame, said bolt cooperating with said catch.

5. The lock mechanism as claimed in claim 4, including means associated with said plug bolt to adjust the height thereof.

6. The lock mechanism as claimed in claim 2, wherein:

said U-shaped section has a base and a pair of longitudinally extending legs defining therebetween said chamber;

each leg of said U-shaped section having at least one longitudinally elongated recess forming at least one pair of recesses, said at least one pair of recesses being aligned crosswise of said U-shaped section; and, said at least one bolt extending through said aligned recesses and having freedom of movement longitudinally within said longitudinally elongated recesses.

7. The lock mechanism as claimed in claim 2, including a lock mechanism associated with said rod; and, means to displace said rod longitudinally of said U-shaped section.

8. The lock mechanism as claimed in claim 7, comprising at least two rods coaxially mounted for sliding movement opposite to each other longitudinally of said vertical chamber device, each of said rods having one end cooperative with said locking mechanism for imparting the sliding movement thereto and another free end;

a plug bolt for each said rods connected with said free end thereof;

a catch for each said plug bolt, one of said catches being mounted on the lintel of said door frame, and the other of said catches is mounted on the threshold of said door frame, one of said plug bolts cooperating with one of said catches and the other of said plug bolts cooperating with the other of said catches; and means to adjust the height of said plug bolts.

9. The lock mechanism as claimed in claim 8, including:

two connecting parts hinged onto said rods, said connecting parts connecting said rods to said locking mechanism.

10. The lock mechanism as claimed in claim 7, including:

a lock barrel for said locking mechanism having an axis;

said lock mechanism comprising a driving disk mounted for rotation on said barrel axis, said driving disk being operable by means of a knob or handle;

said disk comprising two spiral grooves passing around its axis at an angle which can exceed 360°;

a pin integral with said connecting parts for displacement thereof; whereby turning of said actuating disk, said connecting parts are displaced whereby to axially displace said rods.

11. A lock according to claim 2, including catches mounted respectively on the threshhold and the lintel of the door-frame;

catch bolts cooperating with said catches; and, means to adjust said catch bolts in height by means of adjusting systems each comprising a threaded rod at the end part of which is fastened to the corresponding catch bolt, said threaded rod passing through a boring provided on a return introduced on the end part of the corresponding rod, means including two nuts screwed onto said rod, respectively on either side of said boring for adjusting the height of said catch bolts.

12. The lock mechanism according to claim 2, comprising a plug terminal consisting of a rectangular section, open on one side, and covering said vertical chamber device;

means fastening said plug terminal to said vertical chamber device comprising a longitudinal rim on one side cooperating with a rim set on one of the external legs of the chamber of said U-shaped section and by means of a gripper on the other side, and a longitudinal uncoupling lever cooperating with said gripper.

* * * * *